United States Patent [19]

Kessler et al.

[11] 4,181,088

[45] Jan. 1, 1980

[54] UNDERBED THREAD TRIMMER FOR SEWING MACHINES

[75] Inventors: Rolf E. Kessler, Karlsruhe; Reinhold Papajewski, Stutensee-Friedrichthal; Dietmar Polixa, Karlsruhe, all of Fed. Rep. of Germany

[73] Assignee: The Singer Company, New York, N.Y.

[21] Appl. No.: 891,587

[22] Filed: Mar. 30, 1978

[51] Int. Cl.[2] ..... D05B 65/00

[52] U.S. Cl. ..... 112/292; 112/300; 112/289

[58] Field of Search ..... 112/292, 285, 291, 295, 112/296, 298, 300, 289, 294

[56] References Cited

U.S. PATENT DOCUMENTS

| | | | |
|---|---|---|---|
| 3,173,393 | 3/1965 | Adam | 112/292 |
| 3,359,933 | 12/1967 | Bono | 112/292 |
| 3,371,633 | 3/1968 | Hedegaard | 112/292 |
| 3,424,116 | 1/1969 | Von Hagen | 112/292 |
| 3,605,664 | 9/1971 | Hedegaard | 112/292 |
| 3,624,735 | 11/1971 | Hedegaard | 112/292 |
| 3,658,021 | 4/1972 | Hedegaard et al. | 112/292 |
| 3,709,176 | 1/1973 | Papajewski et al. | 112/292 |
| 3,776,161 | 4/1973 | Papajewski et al. | 112/292 |
| 3,894,502 | 7/1975 | Hager et al. | 112/300 X |
| 3,895,591 | 7/1975 | Killinger | 112/289 |

*Primary Examiner*—Ronald Feldbaum

*Attorney, Agent, or Firm*—Michael H. Wallach; Robert E. Smith; Edward L. Bell

[57] ABSTRACT

An underbed thread trimmer mechanism for severing the needle and bobbin threads upon completion of a sewing operation. Operation of the thread trimmer may be selectively initiated by operator command. A plurality of cams and members cooperate to transfer power from a loop taker shaft to a thread handling disc-like member situated in close proximity to the sewing machine loop taker. A thread cutting knife is disposed in covering relation to the thread handling member and cooperates with the thread handling member to trap the needle and bobbin threads and direct them to a knife surface of the thread cutting knife where they are severed. The mechanism that drives the thread trimmer resets itself at the completion of the thread cutting cycle.

4 Claims, 6 Drawing Figures

UNDERBED THREAD TRIMMER FOR SEWING MACHINES

BACKGROUND OF THE INVENTION

1. Field of the Invention

The invention relates to underbed thread trimmer mechanisms for sewing machines.

2. Description of the Prior Art

Underbed thread trimmers for simultaneously trimming both the needle and the bobbin threads are well known in the prior art. Prior art thread trimmers have incorporated combinations of cams and solenoids for drawing a thread against a cutting surface. Many of the known thread trimming mechanisms are bulky and require numerous moving parts to effectuate their purpose. See for example U.S. Pat. No. 3,359,933 of Dec. 26, 1967 to Bono, and U.S. Pat. No. 3,776,161 of Dec. 4, 1973 to Papajewski et al. The area surrounding a loop taker is generally confined and occupied by the drive means required for the loop taker and associated instrumentalities. Thread trimmer mechanisms, which must be located in close proximity to the loop taker, must therefore be compact in size. An additional desirable feature is that they not be prone to jamming. A further constraint is placed on the size and complexity of the thread trimmer mechanism if it is designed to be contained within the feeding post of a post type sewing machine wherein the feeding post is especially prone to crowding of components. See, for example, U.S. Pat. No. 3,371,633 to Hedegaard which shows a thread cutting device adapted for use within the feeding post of a post type sewing machine. An additional limitation stems from the desire to utilize a thread trimmer which will cooperate with the loop taker shaft to provide the driving power for conducting the thread cutting operation, but which will also provide a long excursion of the thread severing means to insure that sufficient thread is withdrawn prior to the thread cutting operation to allow a proper and safe lock stitch to be formed during the next sewing cycle.

SUMMARY OF THE INVENTION

One object of this invention is to provide an underbed thread trimmer which will fit within the feeding post of a post type sewing machine.

Another object of this invention is to provide an underbed thread trimmer which is driven by the rotation of the loop taker shaft of a post type sewing machine.

It is also an object of this invention to provide an underbed thread trimmer whose operating cycle is easily adjusted to the operating cycle of the loop taker.

An additional object of this invention is to provide as a component of the underbed thread trimmer a thread catcher element which engages the needle and bobbin threads when the loop formed by the needle thread is at its widest diameter.

An additional object of this invention is to provide an underbed thread trimmer which severs the needle thread without unfavorably influencing the bobbin thread when it is pulled, thereby insuring the proper starting conditions for a new sewing cycle.

The disclosed objects and other advantages of this invention are obtained by an underbed thread trimming mechanism which is adapted to be contained within the feeding post of a post type sewing machine and which is driven by the rotation of the loop taker drive shaft. A solenoid is incorporated into the drive means to initiate operation of the thread trimming mechanism at the command of the machine operator. The loop taker shaft drives a thread handling disc-like member through a combination of cams and levers. Means are incorporated into the drive mechanism to insure that the thread trimmer is returned to its initial operating position upon completion of the thread trimming cycle. The thread handling member is disposed in close arcuately pivotal relation to the loop taker and contains a thread catcher which operatively engages the needle and bobbin threads at the commencement of the thread trimming cycle. A thread cutting knife is fixed to the feeding post and is situated in covering relation to the thread handling member. The thread cutting knife contains a notched finger which cooperates with the thread catcher to position the needle and bobbin threads so that they may be drawn across the knife surface. The thread handling member is linked to the rotary loop taker shaft by a drive means which permits the member to pivot through a sufficient arc to insure that an adequate length of needle and bobbin thread are withdrawn prior to being severed by the thread cutting knife. A combination of cams and followers are driven by the loop taker shaft to permit the invention to be compactly contained within the interior of the feeding post of a post type sewing machine.

BRIEF DESCRIPTION OF THE DRAWINGS

The above and other objects of this invention will be evident from an understanding of the preferred embodiment which is hereinafter set forth in such detail as to enable those skilled in the art to readily understand the function, operation, construction, and advantages of it when read in conjunction with the accompanying drawings in which.

DESCRIPTION OF THE PREFERRED EMBODIMENT

Figure 1:
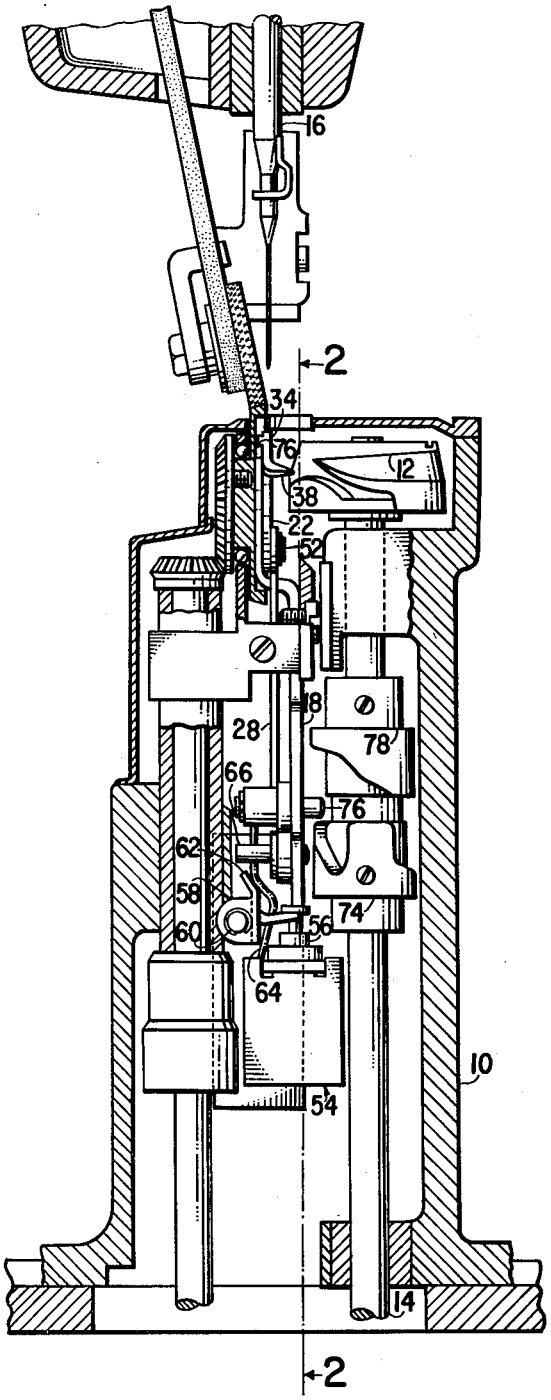
FIG. 1 is a cross-section view of the feeding post of a post type sewing machine having the underbed thread trimmer mechanism of this invention applied thereto.
Figure 2:
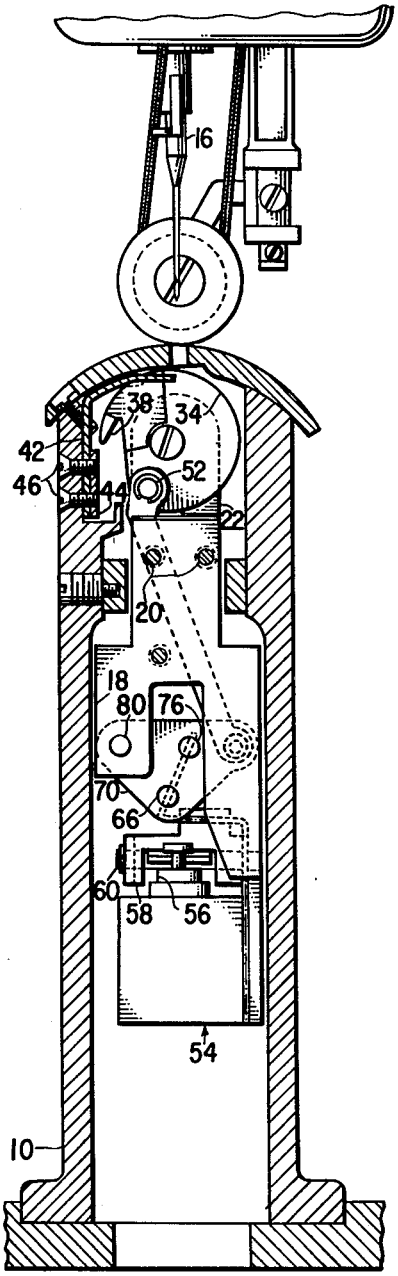
FIG. 2 is a side view of a portion of the post type sewing machine shown in FIG. 1 taken through section line 2—2 shown in FIG. 1.

FIG. 1 of the drawings shows a feeding post 10 of a post type sewing machine to which the underbed thread trimmer mechanism of this invention may be applied. Journalled in the post 10 is a loop taker shaft 14 which has a loop taker 12 attached at one end thereof and which is driven by the loop taker shaft 14 in timed relation to the reciprocation of the needle bar 16.

Figure 3:
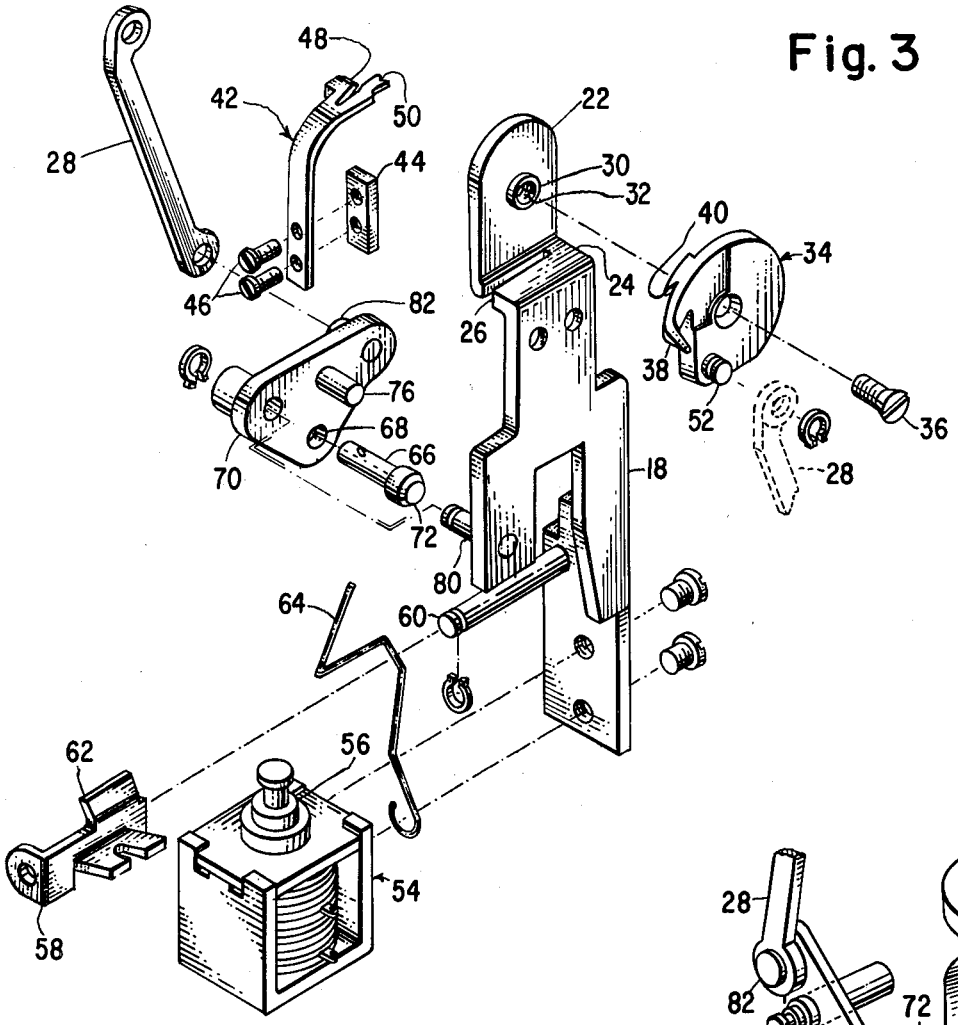
FIG. 3 is an isometric view of the underbed thread trimmer mechanism.

A bracket 18 is attached to the feeding post 10 with conventional fastener means such as screws 20. The bracket 18 has an upper bracket extension 22 which forms an extension of the bracket 18 through the shoulder 24. As best illustrated in FIG. 3, a slot 26 is contained in the shoulder 24 to receive a driving member 28. The upper bracket extension 22 contains a journal 30, having a bore 32 for rotatably mounting a disc-like thread handling member 34 with conventional fastener means such as a screw 36. The member 34 is substantially circular about a major portion thereof and has a thread catcher 38 disposed on its circumference and projecting outwardly from the face adjacent the upper bracket extension 22. A thread cutting finger 40 is also disposed on the circumference of the member 34 and is situated behind the thread catcher 38, and on the opposite face of the member 34.

Figure 6:
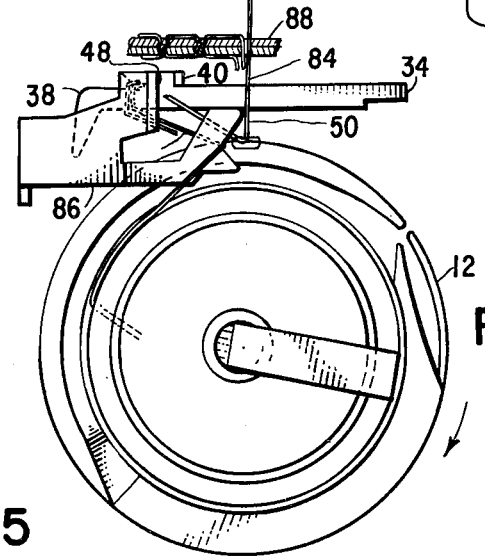
FIG. 6 is a top view of the loop taker mechanism after the needle and bobbin threads have been severed, showing the position of the thread catcher disposed on the thread handling member and the severed threads, and also showing the cooperation between the thread cutting finger mounted on the thread handling member and the knife surface on the thread cutting knife.

A thread cutting knife 42 is shown mounted on the feeding post 10 with a plate 44 and conventional fastener means such as screws 46 in covering relation to the member 34. The thread cutting knife 42 contains a knife surface 48 for severing needle and bobbin threads drawn against it. The thread cutting knife 42 also has a notched finger 50 disposed in spaced relation to the disc-like member 34 for trapping needle and bobbin threads and restraining them until they are engaged by the thread catcher 38 of the disc-like thread handling member. FIG. 6 best shows the cooperation of the thread cutting finger 40 and the notched finger 50 in catching the needle and bobbin threads and restraining them until they are drawn across and severed by the knife surface 48.

The driving member 28 is pivotally attached to the thread handling disc 34 by a shaft 52, whereby reciprocal motion of the driving member 28 will be converted into arcuate reciprocation of the member 34 about the thread handling disc journal 30. The driving member 28 translates in the slot 26 of the shoulder 24 which joins the bracket 18 and the upper bracket extension 22.

The operation of the underbed thread trimmer is initiated by electrially energizing a solenoid 54 which causes a solenoid plunger 56 to retract downward into the body of the solenoid 54. The downward movement causes a tripping pawl 58 to arcuately rotate about a mounting shaft 60. The arcuate rotation of the tripping pawl 58 results in the application of force by an extension tab 62 of the tripping pawl against the backward pressure normally exerted by a return spring 64. The resultant forward biasing of the return spring 64 urges an axially movable follower pin 66 to axially translate through a bore 68 in a swivel lever 70 until its head 72 contacts the track contained on the face of a lower cam 74.

Figure 4:
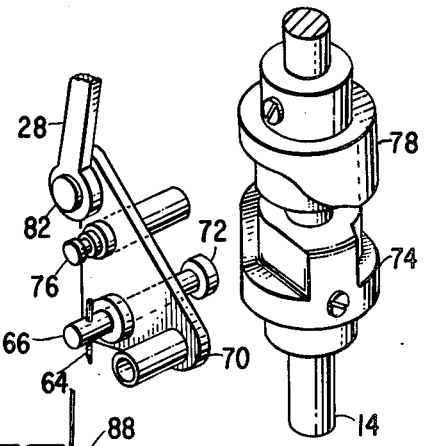
FIG. 4 is an isometric view of the cams and follower pins which cooperate to effectuate the operation of the underbed thread trimmer.

FIG. 4 best illustrates the relation of a fixed follower pin 76 and the axially movable follower pin 66 and an upper cam 78 and the lower cam 74. The engagement of the head 72 of the axially movable follower pin 66 against the track contained in the face of the lower cam 74 causes the swivel lever 70 to pivot about a bearing pin 80 in response to the counterclockwise rotation of the lower cam 74 by the loop taker shaft 14. The pivoting of the swivel lever 70 is transmitted to the thread handling member 34 by the driving member 28 which is pivotally connected to the swivel lever 70 by a driving member pin 82 and pivotally to the thread handling disc 34 by the shaft 52.

The swivel lever 70 continues to pivot about the bearing pin 80 until the fixed follower pin 76 is pivoted into contact with the track contained in the face of the upper cam 78. Shortly before the time that the fixed follower pin 76 first contacts the track of the upper cam 78, the head 72 of the axially movable follower pin 66 will be so situated to be at a void in the face of the lower cam 74. The axially movable follower pin 66 will then be retracted from contact with the lower cam 74 by the tension of the return spring 64 which will urge its head 72 to axially translate backward until it contacts the swivel lever 70. The lower cam 74 will thereafter, and until the next initiation of the thread cutting cycle, be free to rotate in spaced relation to the head 72 of the axially movable follower pin 66.

The continued rotation of the upper cam 78 which is drivingly in contact with the fixed follower pin 76 will cause the swivel lever 70 to reverse its pivotal direction about the bearing pin 80. The reversal of direction of pivoting of the swivel lever 70 provides a reversal in the direction of translation of the driving member 28 which consequently results in a reversal in the direction of arcuate rotation of the member 34. The member 34 thereafter continues its backward rotation until the fixed follower pin 76 is driven out of contact with the upper cam 78 by the movement of the upper cam 78 at which time the fixed follower pin 76 will be located in the free space between the two cams. The underbed thread trimmer will thereby be made ready for the initiation of the next thread trimming cycle and will be uninfluenced by normal rotation of the loop taker shaft.

The preferred embodiment of a driving mechanism which may be used to drive the underbed thread trimmer of this invention has thus been briefly described. A more complete description may be had by reference to the copending application of R. Papajewski which is owned by the common assignee of the present invention.

Figure 5:
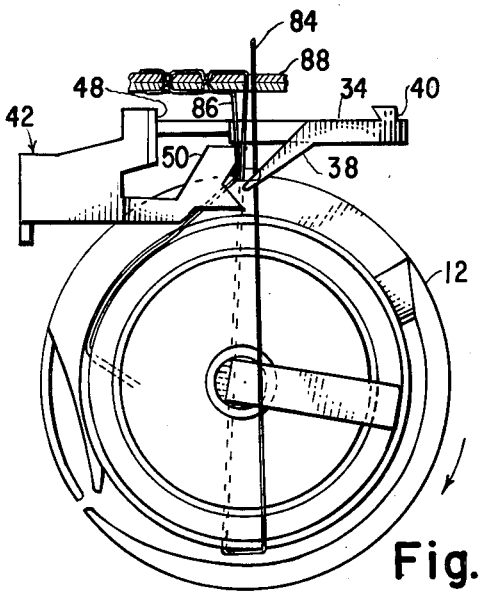
FIG. 5 is a top view of the loop taker of a post type sewing machine with the thread handling member and thread cutting knife of this invention applied thereto, and showing the position of the needle and bobbin threads just prior to being engaged by the thread catcher of the thread handling member.

FIGS. 5 and 6 show the cooperation between the thread handling disc-like member 34, the thread cutting knife 42, and the loop taker 12 to effectuate the purposes of this invention. FIG. 5 is a representation of the positions of the cooperating elements just after the underbed thread trimmer has commenced operation, showing a needle thread 84 and a bobbin thread 86 as they emerge from a work piece 88 and cooperate with the loop taker 12. Rotation of the loop taker 12 proceeds in a clockwise direction. The needle thread 84 is shown in FIG. 5 just before it is cast off by the loop taker 12, which occurs when the loop formed in the needle thread 84 by the loop taker 12 passing therethrough is at its largest diameter. The thread catcher 38, which projects outwardly from the face of the thread handling member 34, engages the needle and bobbin threads by being driven counterclockwise (which is illustrated in FIGS. 5 and 6 as toward the left) by the driving member 28 and by further rotation of the thread handling member 34 sweeps them to the notch formed between the intersection of the thread cutting finger 40 and the thread handling member 34 where they are fixedly restrained. The thread handling member 34 rotates in a direction which causes the thread cutting finger 40 and the restrained threads to move toward the knife surface 48 disposed on the thread cutting knife 42.

FIG. 6 shows the thread handling member 34 rotatably displaced from the position shown in FIG. 5. The bobbin thread 86 is shown fixedly held by the notched finger 50 and the thread cutting finger 40. The needle thread 84 and the bobbin thread 86 are restrained in the notch formed between the thread cutting finger 40 and the thread handling member 34 while they are drawn beneath the knife surface 48 by the rotation of the thread handling member 34. The knife surface 48 is spaced in covering relation to the circumference of the thread handling member 34 and is so disposed to be capable of severing a thread that passes between the knife surface 48 and the circumference of the thread handling member 34. The knife surface 48 severs the needle thread 84 and the bobbin thread 86 as they are drawn under the knife surface by the rotary motion of the thread handling member 34.

After the thread handling member 34 has been sufficiently moved to cause the needle and bobbin threads trapped between the thread handling member 34 and thread cutting finger 40 to be severed by the knife surface 48, the fixed follower pin 76 engages the track on the face of the upper cam 78. Shortly before the upper cam 78 rotates sufficiently to contact the fixed follower pin 76, the axially movable follower pin 66 moves to a void on the face of the lower cam 74. The spring force of the return spring 64 retracts the axially movable follower pin 66 from further contact with the cam 74 and allows it to assume a position in spaced relation to the cam. The continued rotation of the loop taker shaft 14 causes the fixed follower pin 76 to engage the track located on the upper cam 78. As the upper cam 78 rotates, the swivel lever 70 is forced to pivot about the bearing pin 80 as the fixed follower pin 76 is pushed toward the free space between the upper cam 78 and the lower cam 74. The pivoting of the swivel lever 70 causes the driving member 28 to retract from its maximum extended position and consequently causes the thread handling member 34 to reverse its rotation about the journal 30. The thread handling member 34 ceases to rotate when the fixed follower pin 76 enters the free space between the cams 78 and 74, thereby disengaging the thread trimmer driving mechanism from the loop taker shaft. The underbed thread trimmer is thereafter available to commence another thread trimming cycle.

It should be apparent that numerous alterations of the structure herein disclosed will suggest themselves to those skilled in the art. All such modifications which do not depart from the spirit of the invention are intended to be included within the scope of the appended claims.

Having thus set forth the nature of the invention, what is claimed herein is:

1. An underbed thread trimmer for a sewing machine having a rotating loop taker driven by a drive shaft for concatenating a needle thread with a bobbin thread from a bobbin contained within said loop taker, said thread trimmer comprising a thread handling member having a first face and a second face, mounting means for pivotally mounting said thread handling member in spaced relation to said loop taker, a thread catcher extending away from said first face of said thread handling member and toward said loop taker, means defining a thread cutting finger on the periphery of said second face of said thread handling member, said thread cutting finger forming a notch with the intersection of said second face of said thread handling member for operably restraining needle and bobbin threads guided to said thread cutting finger by said thread catcher, drive means for selectively pivoting said thread handling member from an initial position on one side of the stitching location in a first direction about said mounting means to a second position on the other side of the stitching location and for pivoting said thread handling member back to its initial position, said thread catcher catching the needle and bobbin threads during the return movement, a thread cutting knife having a notched finger disposed for cooperation with said thread catcher for restraining said needle and bobbin threads as said thread catcher returns to its initial position and guides the threads to the thread cutting finger, and a knife surface disposed in relation to the path of said thread cutting finger for severing said needle and bobbin threads between said thread cutting finger and said knife finger.

2. An underbed thread trimmer as recited in claim 1 wherein said drive means is operably driven in timed relation to said loop taker by a plurality of cams attached to said loop taker drive shaft.

3. An underbed thread trimmer as set forth in claim 1 wherein said underbed thread trimmer is actuated by an electrical solenoid drivingly connecting said drive means to said loop taker shaft.

4. An underbed thread trimmer as set forth in claim 1 wherein said thread cutting knife is journalled to a feeding post of a post type sewing machine, said notched finger of said thread cutting knife overlying the path of said loop taker for operatively restraining said needle and bobbin threads for engagement by said thread catcher.

* * * * *